US006474744B1

(12) United States Patent
Taylor et al.

(10) Patent No.: US 6,474,744 B1
(45) Date of Patent: Nov. 5, 2002

(54) SPLICING CHAIR

(76) Inventors: John Wayne Taylor, 1062 Rosedale Dr., Montgomery, AL (US) 36107; Grant D. Dicke, 130 Franklin St., Downers Grove, IL (US) 60515

( * ) Notice: Subject to any disclaimer, the term of this patent is extended or adjusted under 35 U.S.C. 154(b) by 110 days.

(21) Appl. No.: 09/715,201

(22) Filed: Nov. 16, 2000

Related U.S. Application Data

(60) Provisional application No. 60/166,033, filed on Nov. 17, 1999.

(51) Int. Cl.[7] ..... A47C 9/02

(52) U.S. Cl. ..... 297/440.22; 297/130; 297/344.18; 297/451.2

(58) Field of Search ..... 297/130, 344.18, 297/440.22, 451.2

(56) References Cited

U.S. PATENT DOCUMENTS

| | | | | |
|---|---|---|---|---|
| 2,703,137 A | * | 3/1955 | Bierman | 297/440.22 |
| 3,934,397 A | | 1/1976 | Black | 57/142 |
| 4,838,608 A | | 6/1989 | Hansen-Smith et al. | 297/27 |
| 5,494,333 A | * | 2/1996 | Wilson | 297/344.18 |
| 6,135,548 A | | 10/2000 | McGuire | 297/163 |
| 6,142,459 A | | 11/2000 | Garrett | 259/11 |
| 6,224,148 B1 | * | 5/2001 | Lee et al. | 297/130 |

FOREIGN PATENT DOCUMENTS

| | | | |
|---|---|---|---|
| DE | 3223143 | * 12/1983 | 297/440.22 |

* cited by examiner

*Primary Examiner*—Peter R. Brown
(74) *Attorney, Agent, or Firm*—Fitch, Even, Tabin & Flannery

(57) ABSTRACT

A cable splicer chair is disclosed that is ergonomically sound in a wide variety of work environments. This seat includes a seat assembly having a backrest and adjustable legs that will allow the chair seat to be level regardless of the terrain upon which the chair is supported. The cable splicer chair includes convenient mechanisms for attaching tools that are used by the cable splicer and locating such tools optimally for an individual cable splicer.

15 Claims, 5 Drawing Sheets

SPLICING CHAIR

CROSS REFERENCE TO RELATED APPLICATIONS

This application is a continuation-in-part of U.S. patent application Serial No. 60/166,033 filed Nov. 17, 1999.

BACKGROUND OF THE INVENTION

1. Field of the Invention

The invention relates to a chair for a cable splicer that is safe and more stable than the box type stools that are now used by cable splicers. This chair can also be used in fusing fiber optic cables.

2. Description of the Related Art

Modem communications systems throughout the world depend upon systems of cables that are made up of multiple individual transmission lines. These cables must be compact to minimize their size to accommodate their extension through the tubes or pipes through which they extend. It is necessary to connect cables at numerous locations along the network of cables that make up the system of cables. When cable systems are changed, expended or repaired, the damaged cables must be spliced together which requires that each individual circuit in a cable be connected to another individual circuit. Such connections must provide a sound electrical or optical connection between the lines and must be insulated from other lines in the cable. Splicing of cables, especially multi-circuit communications cables, require that the splicer is always concentrating on his or her work and provide a precision splice one-hundred percent of the time. The work must be done at the location where the splice is needed which, at best, can be defined as unpredictable and varied. Large commercial buildings may have a special room or cable chamber into which all external cables ingress and egress and are spliced to the internal cables for the tenants of the building. However, cable splicing often must be accomplished within the narrow confines of a manhole. When there is an emergency as a result of a cable being accidentally severed or destroyed, the cable splicers are often required to work long hours, often in harsh circumstances. The conventional seat currently used by cable splicers is shown in FIG. 4. This prior art seat is referred to in the industry as a "butt box" and is provided in both wood and plastic. It provides no back rest whatsoever and is not adjustable to accommodate uneven surfaces. As a result, a cable splicer using the prior art seat is often very uncomfortable, experiences considerable strain and can become fatigued after a relatively short work period.

BRIEF SUMMARY OF THE INVENTION

It is an object of the invention to provide a cable splicer seat that is ergonomically sound in the wide variety of work environments that cable splicing must be accomplished.

It is important that the work environment for a cable splicer be optimized to enable the splicer to concentrate on the work in comfort and safety without suffering physical or mental fatigue.

It is an object of this invention to provide a single efficient, effective, economic, strong, stable, portable, collapsible and compact chair for a cable splicer.

Another objective of this invention is to provide a cable splicer chair that has adjustable legs that will allow the chair seat to be level regardless of the level of the terrain upon which the chair is supported.

Another object of this invention is to provide a cable splicer chair in which the overall dimensions of the footprint of the chair can be adjusted to permit a less than optimum minimum footprint to accommodate working in confined quarters, such as manholes, when required and to be adjustable to an optimum sized footprint for use in larger quarters.

Still another object of this invention is to provide a cable splicer chair that includes convenient mechanisms for attaching tools that are used by the cable splicer and locating such tools optimally for an individual cable splicer.

These and other objects of the present invention are provided in a splicing chair, comprising:

- a seat assembly including a backrest portion pivotally joined to a seat portion so as to be movable between an expanded seating position and a retracted storage position;
- a laterally extending frame assembly including a plurality of support frame members connected together;
- at least one of said frame members being extendable so as to take on a longer length;
- legs extending from ends of the frame members, the legs configurable so as to take on an extended longer length and a retracted shorter length; and
- a seat assembly mount releasably mounting the seat portion above the frame assembly in an operating position and below the frame assembly in a storage position.

Other objects are attained in a splicing chair, comprising:

- a seat assembly including a backrest portion pivotally joined to a seat portion so as to be movable between an expanded seating position and a retracted storage position;
- a frame assembly including a plurality of support frame members of selectable length connected together in a Y-shape;
- legs of selectable length extending from ends of the frame members,
- a pivotal mount selectably mounting the seat portion above the frame assembly in an operating position and below the frame assembly in a storage position; and
- a pivotal mount pivotally mounting said seat assembly to said frame assembly.

DETAILED DESCRIPTION OF THE PREFERRED EMBODIMENTS

Figure 1:
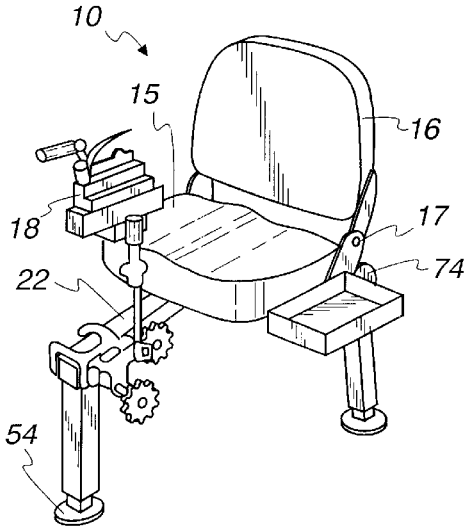
FIG. 1 is a perspective view of applicant's splicing chair in its upright position.

Referring now to the figures, and initially to FIGS. 1–8, a first embodiment of a splicing chair is indicated at 10. Splicer chair 10 includes a frame 20 upon which is mounted a seat assembly 14. The seat assembly 14 includes a horizontal seat portion 15 and a backrest portion 16. The backrest portion 16 can be pivoted to the horizontal seat portion 15 about aligned pivots 17 which will allow the backrest to be stowed parallel to the horizontal seat portion 15 in a compact storage arrangement.

Also shown in FIG. 1 is a conventional presser tool 18 that is used by cable splicers in performing their work. When using the prior art seating device of FIG. 4, this tool is connected or clamped to the box. However, the presser tool cannot always be located optimally for the cable splicer. In applicant's splicer chair, the presser tool can be clamped to the longitudinal section 22 of the frame 20 at a location immediately in front of the cable splicer, and its position and attitude can be readily adjusted to accommodate virtually any position required by the individual cable splicer.

Figure 5:
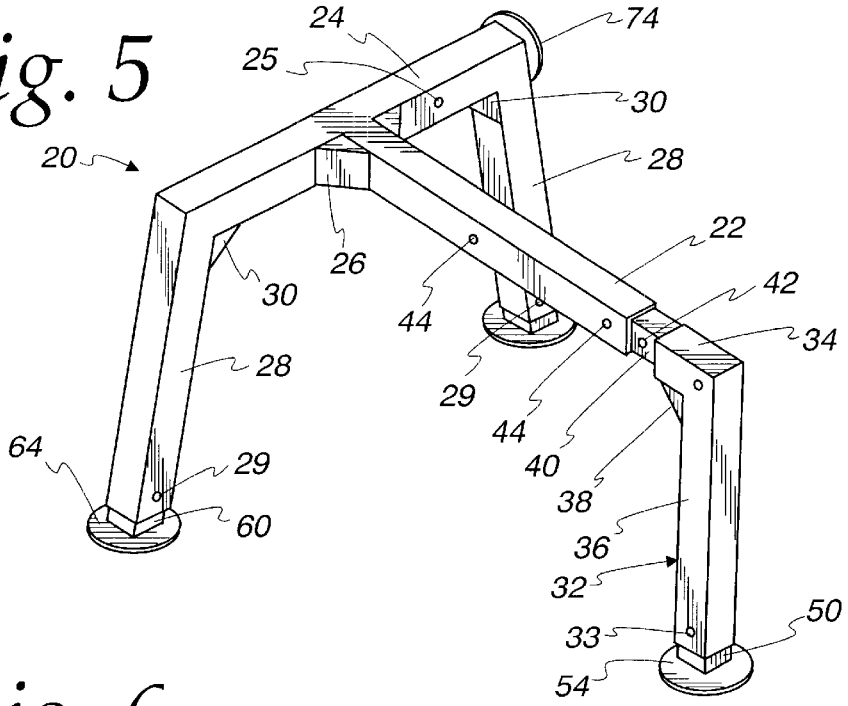
FIG. 5 is a perspective view of the frame for applicant's splicing chair with the legs in place and the spare leg stored.

The frame 20, as best seen in FIG. 5, includes an upper horizontal T-shaped portion that is constructed mainly from square tubes, which are preferably of metallic composition. A longitudinal section 22 is secured, for example, by welding to the center of a lateral section 24. In the preferred embodiment, both the longitudinal and lateral sections are constructed of 1½ inch square metal tubing. Gussets 26 are provided at the connection of the longitudinal section 22 to the lateral section 24 for additional stiffness. An aperture 25 extends through two sides of the lateral section 24 as will be discussed herein. At each free end of the lateral section 24 there is secured a back leg receiving tube 28. The back leg receiving tubes 28 are, in the preferred embodiment, constructed of 1½ inch square tubing and are flared outwardly such that their lower ends are spaced further apart than their upper ends. An aperture 29 extends through two sides of each of the back leg receiving tubes 28. Gussets. 30 are provided at the connection of the lateral section 24 to the back leg receiving tubes 28 for additional stiffness.

A front leg receiving tube 32 includes a horizontal portion 34 and a downwardly extending portion 36 that are secured to each other, for example, by welding. An aperture 33 extends through two sides of the downwardly extending portion 36. In the preferred embodiment, the downwardly extending portion 36 is perpendicular to the horizontal portion 34. A gusset 38 is provided at the connection of the horizontal portion 34 to the downwardly extending portion 26 for additional stiffness.

In the preferred embodiment, the horizontal portion 34 and the downwardly extending portion 36 are constructed of 1½ inch square metal tubing. A smaller square tubing 40 (in the preferred embodiment a 1¼ square metallic tube) is inserted and secured in the open free end of the horizontal portion 34. In the preferred embodiment, a ⅜ inch hole is drilled in three sides of the horizontal portion 34 and plug welds were applied to secure the telescoped tubes together.

Figure 2:
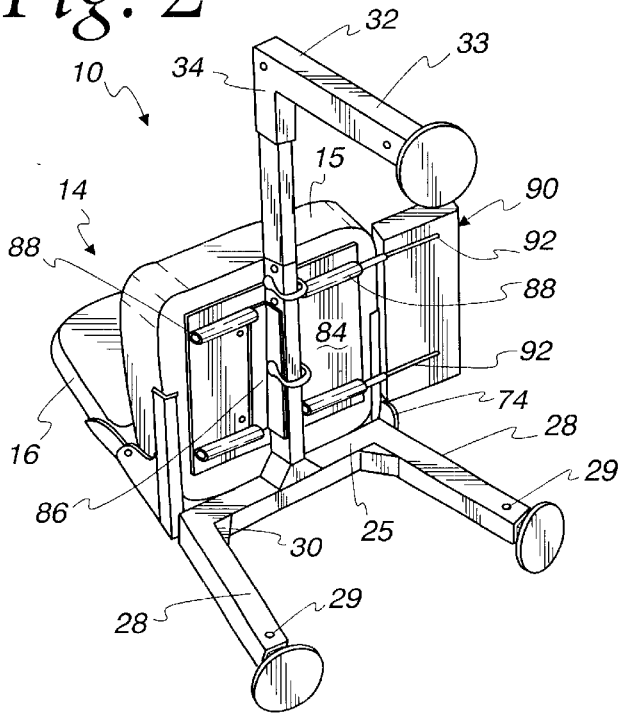
FIG. 2 perspective view of applicant's splicing chair lying on its back to expose its underside.
Figure 4:
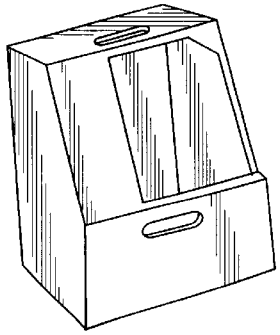
Fig. 4 (Prior Art)
FIG. 4 is a perspective view of a prior art device.

The free end of the smaller square tubing 40 is slid into the open free end of the longitudinal section 22 to thus provide an adjustable telescoping portion for extending the width of the longitudinal section 22. A plurality of horizontal apertures 42 are formed in the smaller square tubing 40 that can be aligned with horizontal apertures 44 formed in the longitudinal section 22. A locking pin, see FIG. 2, is inserted through aligned horizontal apertures 42 and 44 to secure the horizontal section 22 to the front leg receiving tube 32 in a selected adjustable position. As a result of this arrangement, the longitudinal extent of frame 20 is adjustable from a minimum length to permit the splicing chair 10 to be used in crowded work areas, such as at the bottom of a manhole, to a maximum for working in large chambers.

Figure 3A:
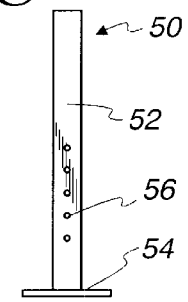
FIGS. 3A, 3B and 3C are isolated front views of the front, back and spare long legs, respectively.

The front leg 50, shown in FIG. 3A, includes a length of tubing 52 which in the preferred embodiment, comprises 1¼ inch square metallic tubing coupled to a ground engaging pad 54, either directly or through a swivel coupling. It should be noted that the pad 54 is arranged normal to the longitudinal axis of the length of tubing 52. A plurality of apertures 56 extend through two sides of the tubing 52. The front leg 50 is telescoped within the open free end of the downwardly extending portion 36 of the front leg receiving tube 32. The aperture 33, formed in downwardly extending portion 36, is aligned with one of the apertures 56 formed in the tube 52 of the front leg 50 and a locking pin (not shown) is inserted through the aligned openings to secure the leg 50 in a selected position.

Figure 3B:
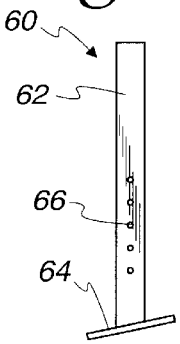

The back legs 60, see FIG. 3B each include a length of tubing 62 (which, in the preferred embodiment, comprises a joinder of a 1¼ inch square metallic tubing) and a ground engaging pad 64. It should be noted that the pad 64 is at an acute angle to the longitudinal axis of the length of tubing 62. A plurality of apertures 66 extend through two sides of the tubing 62. The back legs 50 are telescoped within the open free end of the back leg receiving tubes 28 to provide an adjustable height. The apertures 29, formed in back leg receiving tubes 28, are aligned with one of the apertures 66 formed in the tube 52 of the back leg 50, and a locking pin (not shown) is inserted through the aligned openings to secure the legs 62 in a selected position It should be noted that the pads 64 are horizontal when secured in the selected position.

Figure 3C:
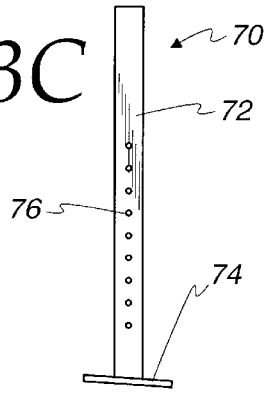

A spare long leg 70, see FIG. 3C, includes a length of tubing 72 (which, in the preferred embodiment, is 1¼ inch square metal tubing) formed to a ground engaging pad 74. This leg is similar to front leg 50, only longer. Spare long leg 70 includes a ground engaging pad 74 and apertures 76. It should be noted that the pad 74 is arranged normal to the longitudinal axis of the length of tubing 72. A plurality of apertures 76 extend through the sides of the tubing 72. The spare long leg 70 is normally stored by telescoping it within an open free end of the lateral section 24 to provide an adjustable height. When in this stored position, the aperture 25 formed in lateral section 24 is aligned with one of the apertures 76 formed in lateral tube 72 of the spare long leg 70 and a locking pin (not shown) is inserted through the aligned openings to secure the leg 70 in its storage position. If the floor in the area where a splicing job must be performed is extremely uneven and the seat assembly 14 cannot be leveled by the full height adjustment range of the front and back legs 50 and 60, respectively, then the spare long leg 70 is removed from its storage location and telescoped into and secured to one of the back leg receiving tubes 28 or the front leg receiving tube 32 in an effort to level the seat assembly 14.

Figure 6:
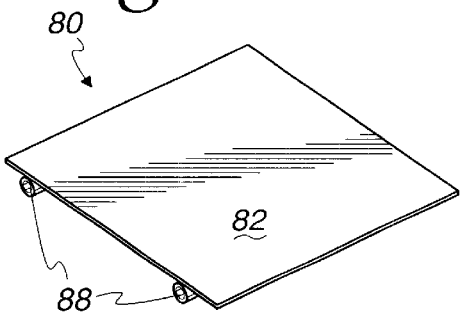
FIG. 6 is a perspective view of the seat mounting plate with the top surface exposed.
Figure 7:
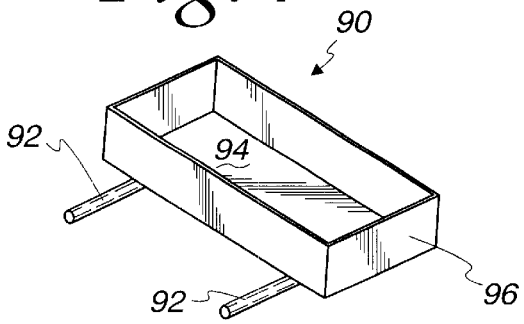
FIG. 7 is a perspective view of the parts tray that is aligned to be mounted in the mounting tubes on the lower surface of the mounting plate of FIG. 6.
Figure 8:
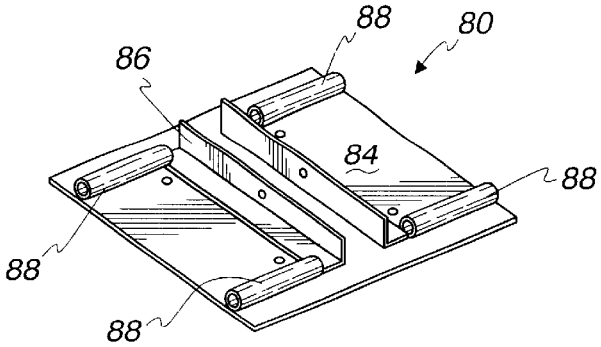
FIG. 8 is a perspective view of the seat mounting plate with the bottom surface exposed.
Figure 9:
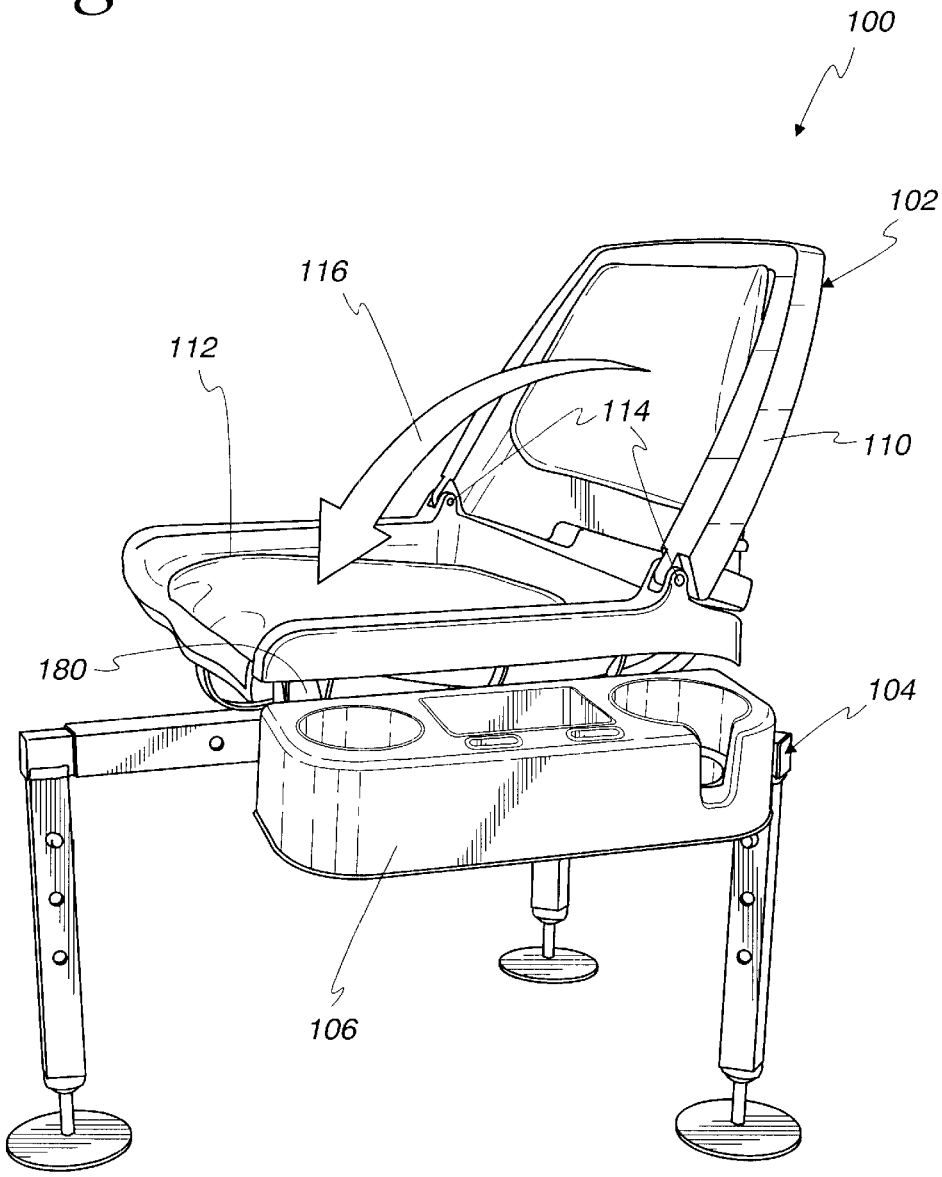
FIG. 9 is a perspective view of an alternative embodiment of a splicing chair according to principles of the present invention.

A seat mounting plate 80 is shown detached from the frame 20 in FIGS. 6 and 7 and attached to the frame 20 in FIG. 2. As best seen in FIG. 8, a pair of channel bar members 86 are secured, for example, by welding to the lower surface 84 of the seat mountings plate 80. The channel bar members 86 are dimensioned and located with respect to each other to form a longitudinal groove 88 that is dimensioned to snugly receive the longitudinal section 22 of the frame 20. An aligned aperture 87 is formed in the vertical flanges of the channel bar members 86 and is aligned with the horizontal aperture 44 formed in the longitudinal section 22 of the frame 20. A locking pin, see FIG. 2, can be inserted in the aligned apertures 87 and 44 to thus releasably secure the seat mountings plate 80 to the frame 20. When secured to the frame, the upper surface 82 of the seat mounting plate 80 faces up and the seat assembly 14 is secured thereto by, for example, bolts and nuts (not shown).

Referring again to FIG. 8, a pair of mounting tubes 88 are secured to both sides on the lower surface 84 of the seat mounting plate. The mounting tubes 88 are dimensioned and located such that they can slidably receive a pair of rods 92 that are secured to the lower surface of a parts tray 90. The parts tray 90 can thus be located on either the right- or left-hand side of the seat assembly 14. The parts tray is disclosed as an open ended rectangular member having a bottom 94 and four upstanding sides 96.

Referring now to FIGS. 9–13, a second embodiment of a splicing chair according to principles of the present invention is generally indicated at 100. Splicing chair 100 includes a seat assembly 102, a frame assembly 104 and a parts tray 106. Seat assembly 102 includes a backrest portion 110 and a seat portion 112. The backrest and seat portion are pivotally connected at 114 to allow the backrest portion 110 to pivot in the direction of arrow 116. Those skilled in the art will readily appreciate that these and other features of the splicing chair according to principles of the present invention provide heretofore unattainable ergonomic advantages. Those skilled in the art of construction and repair splicing who employ the splicing chair will enjoy enhanced productivity, especially when the working on prolonged job operations.

Figure 10:
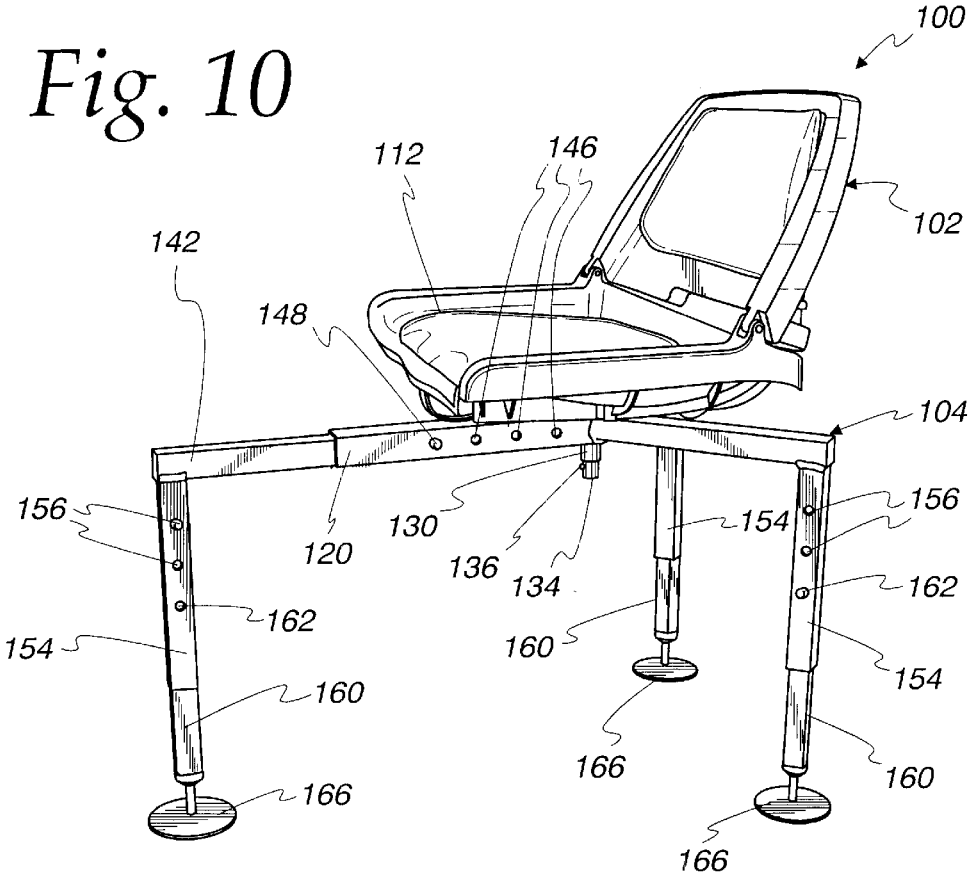
FIG. 10 is a perspective view thereof shown in an alternative configuration.
Figure 11:
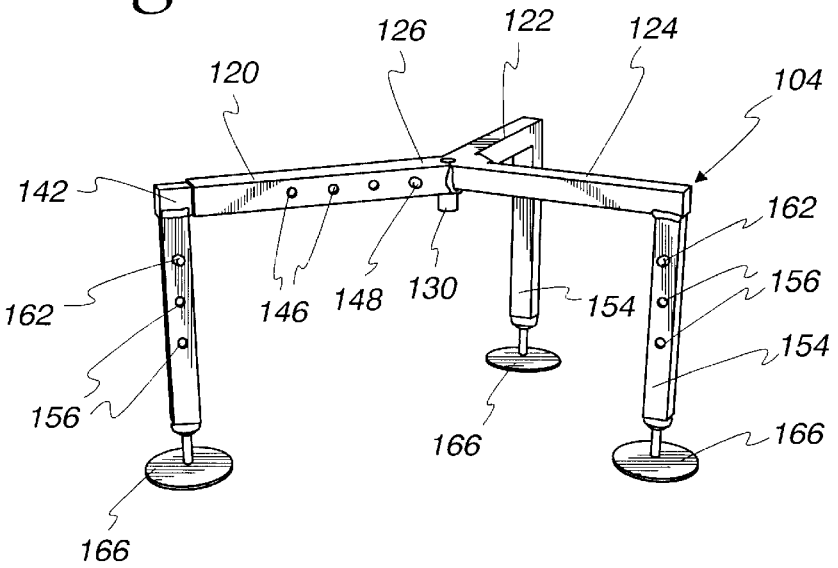
FIG. 11 is a perspective view of the base portion thereof.

FIG. 11 shows frame assembly 104 in a perspective view. Frame assembly 104 includes a plurality of laterally extending frame members 120–124, coupled together to provide an integral support frame. Preferably, legs 120–124 are connected together to form a Y-shape with a common central frame portion 126. Preferably, the central frame portion is drilled to receive a bushing member 130 which is joined to the frame member by a conventional means, such as welding or brazing. Referring to FIG. 10, a mounting post 134 extends from seat portion 112, passing through bushing 130. A spring loaded button 136 prevents inadvertent withdrawal of post 134. If desired, button 136 can be omitted or substituted with other conventional retaining arrangements, such as a cotter pin, hitch pin or bolt.

An extendable frame member 142 is telescopically inserted within frame member 120 so as to be movable between the extended position illustrated in FIG. 10 and the retracted position illustrated in FIG. 11, as well as a number of operating positions between the fully extended and fully retracted positions. Leg member 120 is provided with a series of holes 146 to receive a spring loaded button 148 carried on extendable frame member 142. When button 148 is received in the desired hole 146, the position of extendable frame member 142 and hence the width of frame assembly 104 is fixed as desired. In this manner, a presser tool or other device can be mounted at a desired distance from a user positioned in the seat assembly. Ergonomic advantages are attained since cutter/presser tools and other tools employed in the cable splicing art can be spaced an optimum distance from the seat portion. As will be seen below, further advantages are made possible by the swivel seat, which allows an operator to make fine adjustments as work in the cable splice progresses.

Referring again to FIGS. 10 and 11, a plurality of vertically extending leg mounts 154, each having a plurality of holes 156. As shown, leg mounts are secured at the free ends of frame members 122, 124 and a third leg mount is secured at the free end of adjustable frame member 142. Preferably, leg mounts 154 comprise rectangular metallic tubing of the same general type used to construct frame assembly 104. Referring to FIG. 10, leg mounts 154 telescopically receive legs 160 carrying spring-loaded buttons 162 received in one of the several holes 156 provided in the leg mounts. By manipulating the spring-loaded buttons 162, each leg of the splicing chair can be independently adjusted, to adjust the height of each outside corner of frame member 104. Thus, the splicing chair can be made level despite uneven terrain.

Ground-engaging feet 166 are provided at the bottom free end of each leg 160. Feet 166 shown in the illustrated embodiment comprise a disk or pad mounted to the legs 160. If desired, feet 166 can be substituted for any of a number of conventional foot arrangements, such as swivel feet, ball feet or casters, for example. Although the feet can be mounted with threaded fasteners to legs 160 to provide a further height adjustment, the height adjustment provided by holes 156 in leg mounts 154 has been found to provide an ample range of height adjustment.

Figure 12:
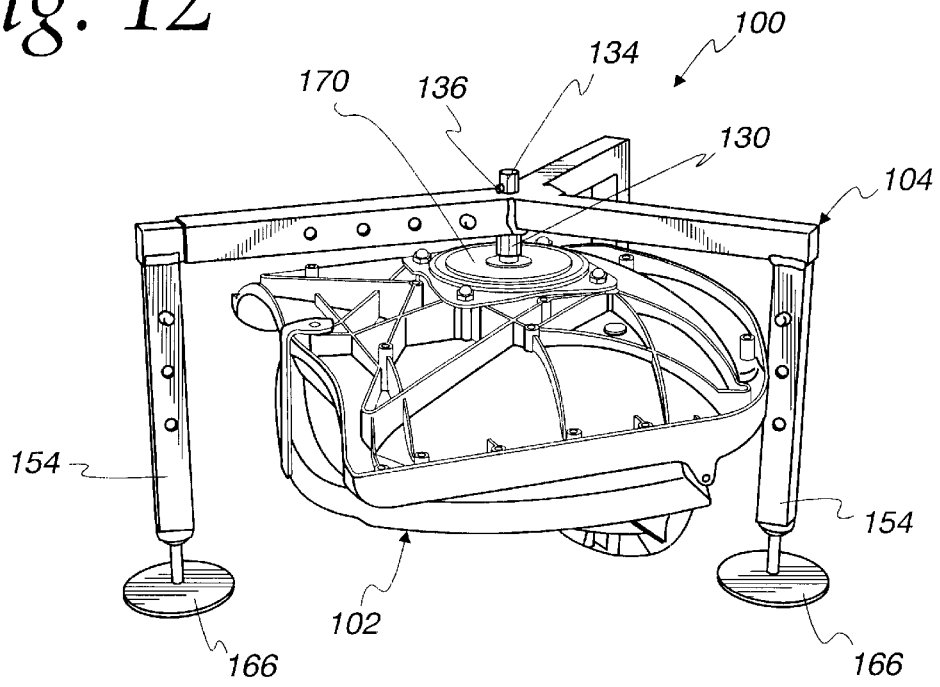
FIG. 12 is a perspective view of the splicing chair disposed in a storage position.
Figure 13:
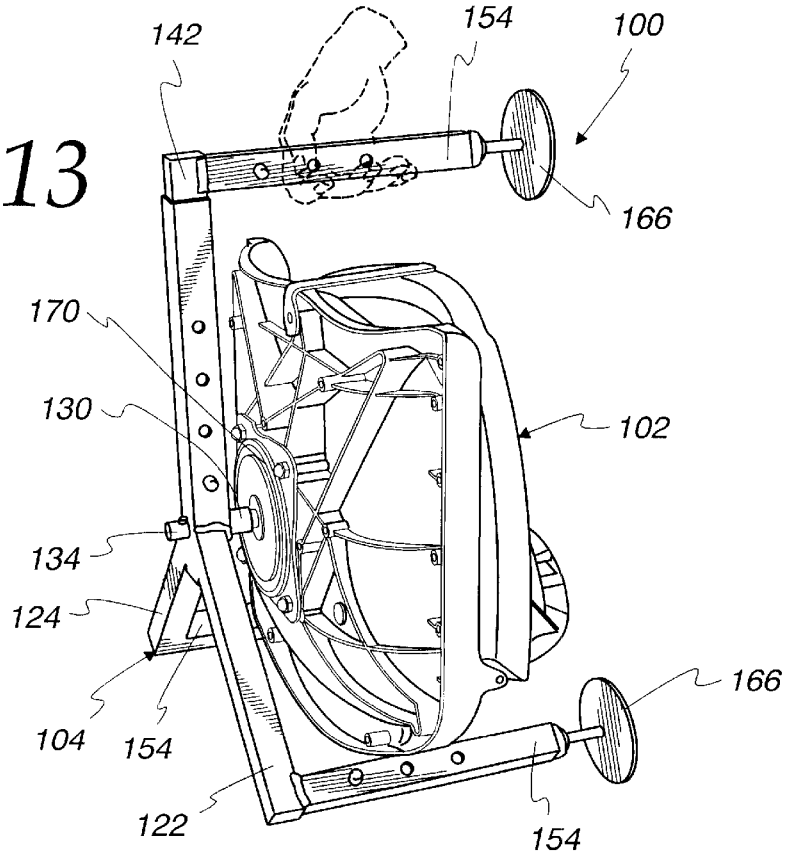
FIG. 13 is a perspective view of the splicing chair made ready for transport.

Referring to FIGS. 12 and 13, splicing chair 100 is shown in an inverted position for storage or transport. By depressing the spring-loaded button 136 of FIG. 10, seat assembly mounting post 134 is allowed to pass through mounting bushing 130. The seat assembly 102 is then inverted in the manner indicated in FIG. 12, and mounting post 134 is re-inserted in bushing 130, this time with the mounting post 134 traveling in an upward direction such that locking button 136 is made to appear atop frame assembly 104, thereby locking the seat assembly 102 to the frame assembly 104. As indicated in FIGS. 12 and 13, frame member 104 is proportioned so as to form a cavity large enough to receive the seating assembly 102. Further, the leg mounts 154 and/or the legs 160 are dimensioned so as to be configured in the manner shown in FIGS. 12 and 13, slightly longer than the collapsed height of seating portion 102. In this manner, splicing chair 100 shown in FIG. 12 is supported by feet 166 with the seating portion 102 suspended above the ground.

As shown in FIG. 12, the desired storage of seat portion 102 is provided with legs 160 fully recessed within leg mounts 154. If shortening of the leg mounts is required, the desired storage of seat portion 102 can be attained by extending the legs to an amount required to suspend seat portion 102 above the plane defined by feet 166. Thus, as will now be appreciated, frame assembly 104 continues a load-bearing function, allowing equipment to be stored on top of splicing chair, as may be required from time to time.

Referring to FIG. 13, splicing chair 100, configured in the storage position, is tipped on end with frame members 122, 124 (and, optionally, leg mounts 154 attached thereto) supporting the weight of the splicing chair, in a stable configuration. As illustrated in FIG. 13, mounting leg 154 secured to the free end of extendable frame member 142 serves as a convenient handle, allowing the splicing chair to be carried from place o place, when not in use.

As indicated in FIGS. 12 and 13, it is preferred that seat assembly 102 be provided with a rotating or turntable mount 170 to allow a user to swivel in a horizontal plane in order to attain maximum ergonomic efficiency during prolonged hours of operation, such as those associated with splicing of multi-circuit communications cables. As is appreciated by those skilled in the cable splicing art, multi-circuit cables carrying a large number of circuits require splices which are staggered along the length of the cable. With the swivel mount 170, a user can rotate the chair assembly in a horizontal plane to provide the alignment and ergonomic positioning necessary for fine hand movements without undue fatigue. As mentioned above, other ergonomic positioning features are provided by the independent height adjustment of the outside corners of frame assembly 104 and by selective lengthening of extendable frame member 142 which mounts the cable splicing or other tool employed by the user.

Additional advantages of the splicing chair according to principles of the present invention are also possible. For example, while a presser tool is often-times the focus of interest for cable splicing operations, work in certain environments may require additional equipment. For example, in an outdoor, sunny environment it may be desirable to suspend an umbrella over the work area. With the frame assembly of the present invention, additional points of attachment for auxiliary equipment is provided by frame members 122, 124. An umbrella required for sunny locations or an inspection light required for dark locations can be conveniently mounted on frame members 122, 124, without disturbing a tool mounted adjacent frame member 120. As mentioned above with reference to FIG. 9, a parts tray 106 can be conveniently mounted to either side of seating assembly 102 by support brackets 180. Although less preferred, the parts tray or other auxiliary devices can be mounted from leg mount 120 or the other leg mounts 122, 124.

With simultaneous adjustment of all three legs 160, the seat assembly 102 can be raised or lowered without changing the angle of the seating plane (e.g., the seat assembly can be oriented in a horizontal plane, despite raising and lowering). It will be observed that, despite numerous adjustments which can be made to the splicing chair, a stable three-point support is provided for the user's weight as well as the weight of equipment supported by the splicing chair.

As mentioned, the frame assembly, leg mounts and legs are preferably constructed of rectangular metallic tubing. Those skilled in the art will readily appreciate that other types of cost effective materials, such as pipe or channels of varying cross-section, as well as plastic or other di-electric materials, can also be used. As a further option, portions of the frame assembly leg mounts and legs can be made of di-electric material so as to provide a "gap", interrupting a path to ground.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A splicing chair, comprising:

a seat assembly including a backrest portion pivotally joined to a seat portion so as to be movable between an expanded seating position and a retracted storage position;

a laterally extending frame assembly including a plurality of support frame members connected together;

at least one of said frame members being extendable so as to take on a longer length;

legs extending from ends of the frame members, the legs configurable so as to take on an extended longer length and a retracted shorter length; and a seat assembly mount releasably mounting the seat portion above the frame assembly in an operating position and below the frame assembly in a storage position.

2. The splicing chair of claim 1 wherein said seat assembly mount comprises a pivotal mount for mounting said seat portion to said laterally extending frame assembly.

3. The splicing chair of claim 1 wherein said seat assembly mount includes a mounting post extending from said seat portion.

4. The splicing chair of claim 3 wherein said frame assembly defines a hole for receiving said mounting post.

5. The splicing chair of claim 4 further comprising a bushing in said frame assembly, receiving said mounting post.

6. The splicing chair of claim 1 wherein said frame assembly comprises three support frame members connected together in a Y-shape.

7. The splicing chair of claim 1 wherein said at least one frame member comprises first and second telescopically interfitting members, one telescopically received within the other.

8. The splicing chair of claim 1 wherein said legs comprise first and second telescopically interfitting members.

9. The splicing chair of claim 1 further comprising a parts tray mounted to one of said seat assembly and said frame assembly.

10. A splicing chair, comprising:

a seat assembly including a backrest portion pivotally joined to a seat portion so as to be movable between an expanded seating position and a retracted storage position;

a frame assembly including a plurality of support frame members of selectable length connected together in a Y-shape;

legs of selectable length extending from ends of the frame members, a pivotal mount selectably mounting the seat portion above the frame assembly in an operating position and below the frame assembly in a storage position; and said pivotal mount pivotally mounting said seat assembly to said frame assembly.

11. The splicing chair all of claim 10 wherein said pivotal mount comprises a turntable mount secured to said seat portion.

12. The splicing chair of claim 11 wherein said pivotal mount comprises a mounting post extending from said turntable mount and wherein said frame assembly includes a bushing for receiving said mounting post.

13. The splicing chair of claim 10 wherein said legs comprise first and second telescopically interfitting members.

14. The splicing chair of claim 10 wherein said frame members include first and second telescoping members, one telescopically inserted in the other.

15. The splicing chair of claim 14 wherein said first telescoping member is joined to a plurality of said support frame members, and said second telescoping member telescopically inserted within said first telescoping number.

* * * * *